US006253597B1

(12) United States Patent
Hogendoorn et al.

(10) Patent No.: US 6,253,597 B1
(45) Date of Patent: Jul. 3, 2001

(54) BODY-NECKING A WALL-IRONED CAN

(75) Inventors: Auke Hogendoorn, Heerhugowaard; Jacobus Frans Nak, Uitgeest; Hans Nicolaas Schaaper, Heemskerk, all of (NL)

(73) Assignee: Corus Staal B.V., Ca Ijmuiden (NL)

( * ) Notice: Subject to any disclaimer, the term of this patent is extended or adjusted under 35 U.S.C. 154(b) by 0 days.

(21) Appl. No.: 09/396,417

(22) Filed: Sep. 15, 1999

Related U.S. Application Data

(63) Continuation-in-part of application No. 09/025,789, filed on Feb. 19, 1988, now abandoned.

(30) Foreign Application Priority Data

Feb. 21, 1997 (NL) ..... 1005340

(51) Int. Cl.[7] ..... B21D 51/26
(52) U.S. Cl. ..... 72/379.4; 413/69
(58) Field of Search ..... 72/348, 352, 356, 72/370.25, 379.4; 413/69

(56) References Cited

U.S. PATENT DOCUMENTS

| | | | | |
|---|---|---|---|---|
| 3,029,507 | * | 4/1962 | Gaggini | 72/343 |
| 3,610,018 | * | 10/1971 | Swanson et al. | 413/69 |
| 3,771,476 | * | 11/1973 | Heinle | 72/352 |
| 3,786,957 | | 1/1974 | Hilgenbrink . | |
| 3,812,696 | * | 5/1974 | Kneusel et al. | 72/352 |
| 4,774,839 | * | 10/1988 | Caleffi et al. | 72/356 |
| 5,275,033 | * | 1/1994 | Riviere | 72/62 |
| 5,355,710 | | 10/1994 | Diekhoff . | |

FOREIGN PATENT DOCUMENTS

| | | | | |
|---|---|---|---|---|
| 715960 | | 10/1996 | (AU) . | |
| 61176433 | | 8/1995 | (EP) . | |
| 733415 | | 9/1996 | (EP) . | |
| 2 606 686 | * | 5/1988 | (FR) | 72/379.4 |
| 60-87930 | * | 5/1985 | (JP) | 72/379.4 |
| 61-176433 | * | 8/1986 | (JP) | 413/69 |
| 1005340 | | 8/1998 | (NL) . | |

OTHER PUBLICATIONS

Beranger, Gerard; Henry, Guy; and Sanz, Germain, The Book of Steel, pp. 773–774.
Lankford, William T. Jr.; Samways, Norman L.; Craven, Robert F.; McGannon, Harold E., The Making, Shaping and Treating of Steel, 10th ed., p. 1156.

* cited by examiner

*Primary Examiner*—Lowell A. Larson
(74) *Attorney, Agent, or Firm*—Stevens, Davis, Miller, Mosher, LLP

(57) ABSTRACT

Method for manufacturing a metal, body-necked can with an ironed wall, for example one intended for being provided on one open side with an easily opening lid in order thereby to form a beverage can, comprising the stages of reducing the diameter of the can with the ironed wall by necking the wall up a considerable part of the height of the can, to be referred to as body-necking, and applying a neck rim by necking the top rim of the can, whereby prior to being body-necked the can is first necked.

28 Claims, 2 Drawing Sheets

BODY-NECKING A WALL-IRONED CAN

This application is a continuation-in-part of U.S. Patent application No. 09/025,789, filed Feb. 19, 1998, now abandoned, incorporated herein by reference.

1. Field of the Invention

The invention relates to a method for manufacturing a metal, body-necked can with an ironed wall, for example one intended for being provided on one open side with an easily opening lid in order thereby to form a beverage can, comprising the stages of reducing the diameter of the can with the ironed wall by necking the wall up a considerable part of the height of the can, to be referred to as body-necking, and applying a neck rim by necking the top rim of the can.

BACKGROUND OF THE INVENTION

Such a method is known. EP 0 733 415 A1 for example discloses the manufacturing of a beverage can comprising a body with zones having different diameters by drawing a cup from a blank, reducing the diameter thereof by a restraining operation and thereafter locally increasing the diameter by an expanding operation.

According to such a method the diameter of the rudimentary can body is firstly reduced. Then an expanding process is used to give the can a different shape e.g. in a shaping mould. In order to complete the beverage can subsequently a neck rim is formed at the top of the can to which the lid can be fitted.

JP 61-176433 to Ouchi discloses a method of shaping a can body made by impact extrusion or deep-draw molding. Ouchi narrows the shoulder part and the base part of the soft-walled can in two operations, after necking and curling the rim, in order to suppress deformation of these parts during later shaping. After that, the part of the can of original diameter is shaped by pressing the wall in and against shaped dies. Ouchi is not body necking.

In the known method, to (body-) neck a can with an ironed wall, the can is moved into a profiled die so that the profile of the die is transferred to the can. However, if a considerable part of the height of the body, or a majority of the height of the body, or the entire body is body-necked to a smaller diameter, there is a chance of wrinkling. In order to suppress or prevent such wrinkling the can must be supported internally by a knock-out in the neck zone during body-necking. Before expanding, the top rim must first be necked into a neck rim. This necking causes damage to the in-can paint and wrinkling in the neck part close to the top rim of the can. The wrinkling is connected and associated with the presence of a large gap during body-necking in the area of the body because the body is adapted to the thicker rim of the can. This gap is taken to be the gap located between the knock-out and the die. During necking the can rim fits precisely in that gap. However, the can rim is thicker than the can wall so that it has sufficient deforming reserve to be necked. However, the knock-out diameter is adapted to that thicker can rim. If the knock-out diameter were adapted to the can wall thickness, then the gap would be too small for the can rim. Therefore, adapting the knock-out diameter to the can rim thickness means that the gap is too large for the can wall, so that the chance of the can wall wrinkling increases (see FIG. 1).

The skilled person confronted with the problem of how to shape a metal can with an ironed wall faces a number of problems.

Common knowledge tells one skilled in the art that the ironed wall:

- has a flow stress of at least 700 MPa (see "The Book of Steel", 1996, Lavoisier Publishing Inc., Secaucus, N.J., Chapter 35, section 2; and also EP 0733415, page 2, lines 47–51), which makes it hard to plastically deform an ironed wall;
- is thin, generally less than 0.14 mm (see "The Book of Steel", 1996, Lavoisier Publishing Inc., Secaucus, N.J., Chapter 35, section 2);
- is expandable by at most about 1% (see EP 0733415, page 2, lines 47–51), or the ironed wall would rupture.

Common knowledge further tells one skilled in the art that, on the contrary, an extruded wall or a deep-drawn molded wall:

- has a low flow stress of typically 250 MPa (see "The Book of Steel", 1996, Lavoisier Publishing Inc., Secaucus, N.J., Chapter 35, section 2; and also see EP 0733415, page 2, lines 12–19);
- is always thicker than an ironed wall because an ironed wall is obtained by ironing an extruded wall or a deep-drawn molded wall (see "The Book of Steel", 1996, Lavoisier Publishing Inc., Secaucus, N.J., Chapter 35, section 2; and also see "The Making, Shaping and Treating of Steel", Unites States Steel, 10th edition, page 1136, lines 27–33);
- is consequently expandable by up to 20% (see EP 0733415, page 2, lines 12–19).

EP 0733415 discloses that in order to expand an ironed wall (see EP 0733415, page 2, line 57 - page 3, line 1) a restraining operation must be performed at least to the section of the can wall that is subsequently to be shaped by an expanding operation (EP 0733415, page 3, lines 2–13).

However, EP 0733415 presents a new problem, because body-necking an ironed wall tends to cause wrinkling as a result of the high pressure that needs to be applied to the wall to overcome the high flow stress in order to plastically deform the ironed wall, in combination with the fact that the wall is very thin.

JP 61-176433 to Ouchi explicitly discloses operations for an extruded wall or a deep-drawn molded wall (See JP '433, page 4, lines 6–9 of top right hand column). Ouchi also states:

> In the method of manufacturing of the present invention, drawing (D1), (D2) is performed on the base part (8) and shoulder part (5) prior to pressing (E) being performed. For this reason only the body part, which is of comparatively low rigidity and protrudes outwards compare to the other sections, is pressure-deformed.

(see JP '433, page 3, lines 7–11).

Ouchi (JP '433) discloses that an unrestrained section is suitable for further shaping because it is of comparatively low rigidity. Yet for ironed walls it is exactly opposite, in that a restrained section is suitable for further shaping as disclosed in EP '415, while an unrestrained wall is not. Hence, it is an unambiguous fact that Ouchi does not disclose ironed walls, neither implicitly nor explicitly.

SUMMARY OF THE INVENTION

Tests have shown that wrinkling can be prevented and that a simpler manufacturing method is possible if, and the invention is based essentially on this, prior to being body-necked, the can is first necked.

The neck applied for body-necking gives the can body rigidity and holds it under tension so that wrinkling is prevented during body-necking. The method in accordance with the invention makes it possible to body-neck without a knock-out. However, because of the axial loading of the can during body-necking, the body must be supported during body-necking by applying an internal overpressure. Furthermore, during body-necking a centering pin is used with a diameter equal to the internal neck diameter of the can.

In practice it is found in accordance with the invention that it is possible to form from a θ 66 mm body a can with a circumference of less than θ 63.5 mm or even θ 62 mm with a 202 neck. A 202 neck is taken to be a neck with a diameter (including the flange with which the lid is applied) of 2 2/16 inch (=53.98 mm). The internal diameter of the can neck is then approximately 52.3 mm.

The invention is also embodied in a method for manufacturing a shaped can by inflating a can which is obtained by applying the method in accordance with the present invention.

After pressure loads have been introduced in the material by body-necking, the material is better able to stretch and the can is able to be formed to a considerable extent, for example by inflating.

The method in accordance with the invention has been found highly suitable for cans manufactured from a packaging steel suited to wall-ironing, and manufactured from an aluminum alloy suited to wall-ironing.

BRIEF DESCRIPTION OF THE DRAWINGS

The invention will now be further illustrated by reference to the drawings in which.

DETAILED DESCRIPTION OF THE PREFERRED EMBODIMENTS

Figure 1C:
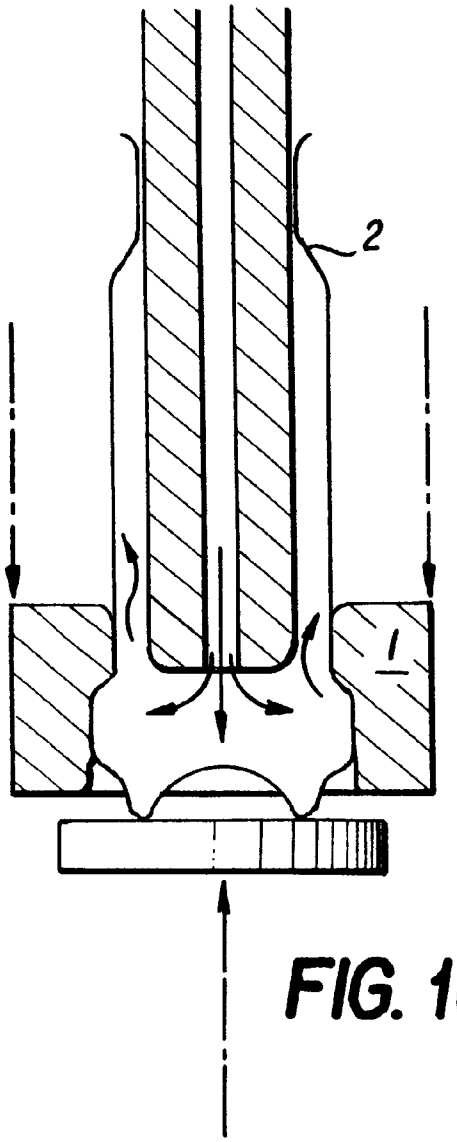
FIGS. 1(*a*)–(*c*) show schematically the successive stages of the method in accordance with the invention.
Figure 1B:
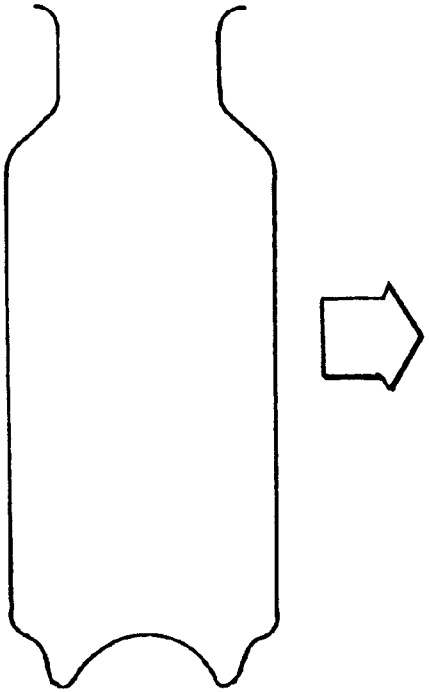
Figure 1A:
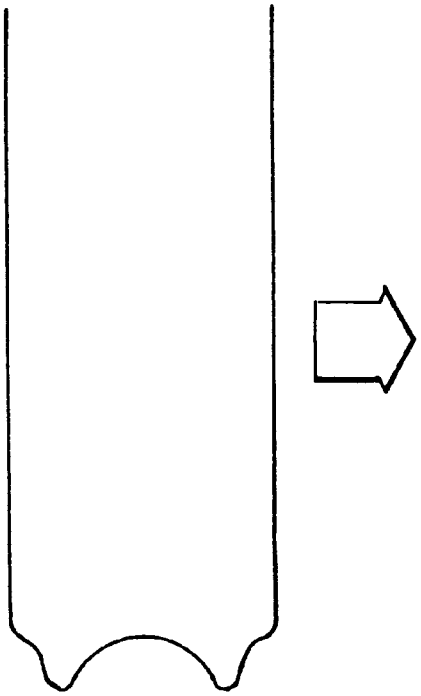

FIGS. 1(*a*)–(*c*) show schematically the result of three sub-processes a, b and c of the method in accordance with the invention. FIG. 1*a* shows a wall-ironed can with a θ 66 mm which in FIG. 1*b* is transformed into a necked can with a 202 neck and a flange. In FIG. 1*c* the 202 necked can is body-necked in a die(1) into a circular cylindrical body with an outside diameter of less than θ 63.5 mm or even less than θ 62 mm. With a hollow centering pin (2) with an outside diameter equal to the internal neck diameter of the can, the can is placed under an internal overpressure for example by using compressed air.

Figure 2:
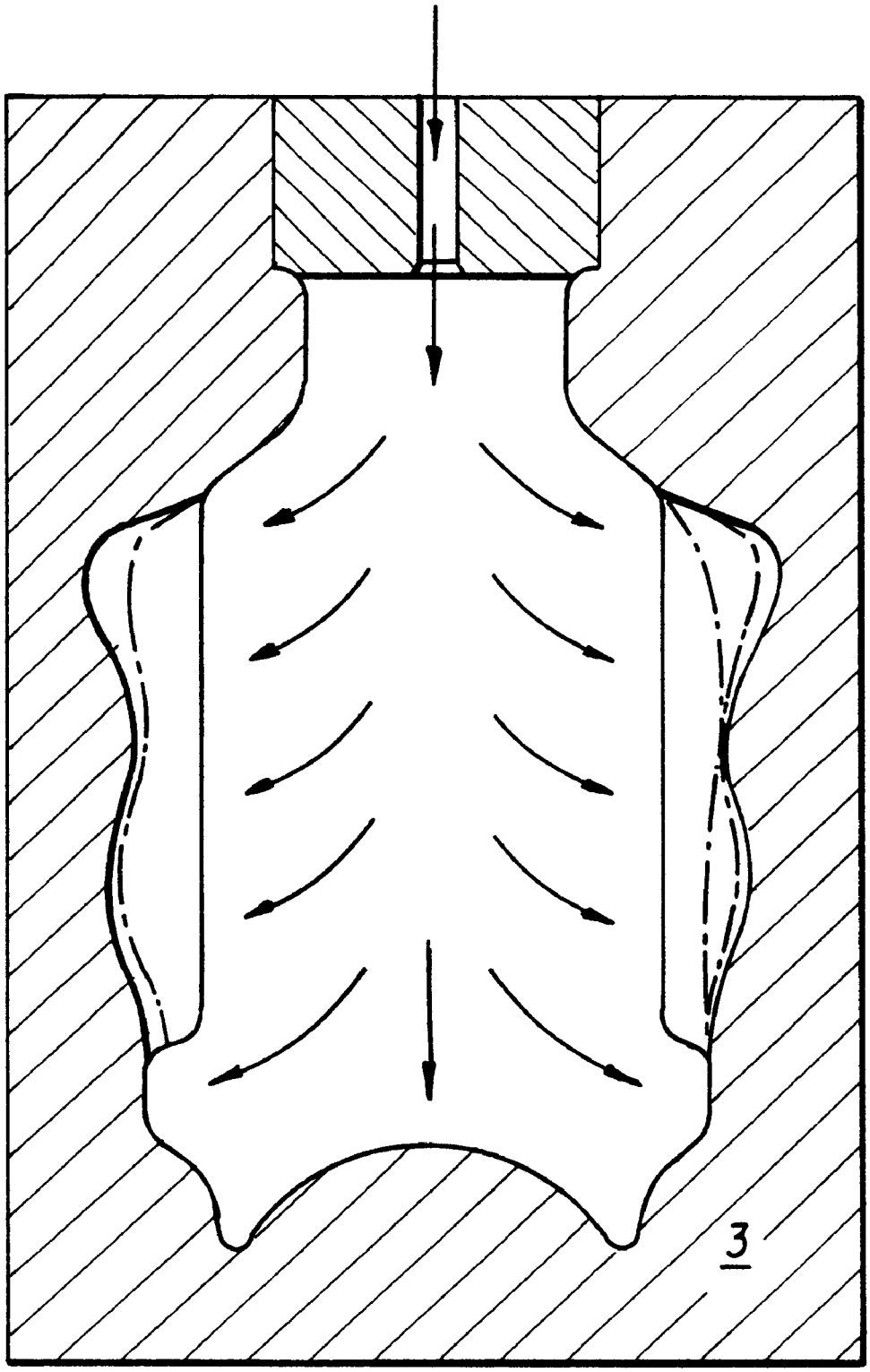
FIG. 2 shows schematically the inflating of a necked, body-necked body in accordance with the invention.

FIG. 2 shows schematically the inflating procedure in a shaping mold (3) of the body-necked, wall-ironed, circular cylindrical body from FIG. 1*c* into a shaped can.

As shown in the Figures, body necking is performed up a considerable length along the sidewalls of the can. For example, as shown in the Figures, body necking is performed up a majority of the length along the sidewalls of the can. Of course, if desired, body necking may be performed up the entire length along the sidewalls of the can.

The term "body-necking" is a term of art. Body-necking is a restraining operation in which the diameter of the can body is reduced by forcing it through a die ring. The length of the can body increases during body-necking.

One of the objectives of the present invention is to shape a body-necked metal can with an ironed wall in an expanding operation, as shown in FIG. 2. "Body-necking" involves a restraining operation prior to an expanding operation. An ironed wall, as opposed to an extruded wall, consists of "full hard material", that would rupture if one tried to expand it. EP 0 733 415 teaches a method for expanding a wall ironed can which employs body-necking. EP '415 discloses that, prior to expanding a section of the can, a restraining operation is applied explicitly to that section. This is typical of body-necking.

In the present invention, gas pressure need not be applied to inflate the can during body-necking. However, gas pressure is provided to support against the axial loading of the can during body-necking.

The present invention differs from JP 61-176433 to Ouchi. Ouchi is not body-necking its can. Ouchi describes a method of changing the shape of a can body by pressing it in and against pre-shaped dies. This does not relate to manufacture of a can body employing body-necking. Ouchi does not disclose an ironed wall. Ouchi discloses an extruded wall or a deep drawn molded wall. In contrast, the present method acts on an ironed wall and the present product involves an ironed wall. Cans made from extruded walls differ from cans made from ironed walls. As known from, for instance, EP 0 733 415, the expanding capacity of an ironed wall can is greatly improved by performing a restraining operation prior to an expanding operation. Ironed walls are far less expandable than extruded or deep-draw molded walls. An ironed wall, as opposed to an extruded wall, consists of fully hard material, that would rupture if one would attempt to expand it without a preceding deforming operation. The purpose of using wall ironed material for cans is that the full hard material provides the strength, needed especially in cans with thinner walls and reduced weight.

Due to the fact that ironed walls are much thinner than extruded walls, combined with the fact that the flow stress of ironed walls is much higher, there is an increased risk of wrinkling during restraining operations of ironed walls. The ironed wall is always much thinner than Ouchi's extruded walls. Therefore, wrinkling is not an issue for Ouchi and it is unexpected that body necking of the present invention works with ironed walls without causing wrinkles.

Annealing a can of wall ironed material, could provide a soft can body suitable for shaping. However, it would be required to regain the strong full hard material after the shaping operation, which is perhaps possible but certainly not easy. In contrast, the present invention employs wall ironed material, and thus, the full hard can wall is sufficiently hard immediately after an expansion operation. The body-necked can of the present invention could be seen as a semi-finished product of such a deforming operation.

Body-necking restrains the part of the can wall which is later expanded. In contrast, Ouchi restrains a different part of the can wall than it expands. Ouchi applies a restraining operation to only the base part and shoulder part of the can wall, while the main part of the body is to be shaped. The Japanese text of Ouchi, page 3, discloses: "In the method of manufacturing of the present invention, drawing (D1), (D2) is performed on the base part (8) and shoulder part (5) prior to pressing (E) being performed. For this reason, only the body part, which is of comparatively low rigidity and protrudes outwards compared to the other sections, is pressure-deformed." It is clear that, Ouchi specifically restrains part of the can wall with the goal to suppress deformation of this part during later operations. The present body-necking operation does the opposite: it shapes part of the can wall by body-necking to enhance deformability of the body-necked part of the can during later operations.

What is claimed is:

1. A method for manufacturing a metal, body-necked can with an ironed wall, comprising the steps of:

applying a neck rim by necking the top rim of the can, wherein said applying of said neck rim comprises forming a neck and a shoulder about the neck, the shoulder having an outside diameter, reducing the diameter of the shoulder and the can with the ironed wall by body-necking the wall up a considerable part of the height of the can, wherein said body-necking comprises moving the can axially through and relatively to a profiled die to transfer the profile of the die to the can, and wherein said applying of said neck rim occurs prior to said body-necking, wherein the shoulder is defined between the neck and the body-necked part of the can, and the body necking does not eliminate the shoulder.

2. The method in accordance with claim 1, wherein the body-necking is carried out with a centering pin inserted into the neck of the can, the centering pin having a circular cylindrical shape with an outside diameter corresponding to an internal neck diameter of the neck rim, said neck is not narrowed by said body-necking, and only said die ring is in direct contact with the part of the can walls being body-necked during said body-necking.

3. The method in accordance with claim 2, wherein the can is intended for being provided on one open side with an easily opening lid thereby to form a beverage can.

4. The method for the manufacture of a shaped can by inflating a body necked portion of a can which is obtained by applying the method in accordance with claim 2.

5. A body-necked, wall-ironed can obtained from the method in accordance with claim 2, wherein the can is manufactured from packaging steel.

6. A body-necked, wall-ironed can obtained from the method in accordance with claim 2, wherein the can is manufactured from aluminum.

7. The method in accordance with claim 2, wherein gas is injected through said centering pin into the can during said body-necking to place the can under an internal overpressure to support against axial overloading of the can during said body-necking.

8. The method in accordance with claim 7, wherein the gas is injected through said centering pin into the can during said body-necking while the centering pin is located in the can to have a discharge end below the neck of the can.

9. The method in accordance with claim 1, wherein a can of θ 66 mm is necked to a 202 top diameter and then body-necked into a circular cylindrical body with an outside diameter of less than θ 63.5 mm.

10. The method in accordance with claim 1, wherein a can of θ 66 mm is necked to a 202 top diameter and then body-necked into a circular cylindrical body with an outside diameter of less than θ 62 mm.

11. The method for the manufacture of a shaped can by inflating the body-necked part of a can which is obtained by applying the method in accordance with claim 1.

12. The method for the manufacture of a shaped can of claim 11, wherein the can is intended for being provided on one open side with an easily opening lid thereby to form a beverage can.

13. A shaped can obtained from the method of claim 11, wherein the can is manufactured from packaging steel.

14. A shaped can obtained from the method of claim 11, wherein the can is manufactured from aluminum.

15. A body-necked, wall-ironed can obtained from the method in accordance with claim 11.

16. A body-necked, wall-ironed can obtained from the method in accordance with claim 11, wherein the can is manufactured from packaging steel.

17. A body-necked, wall-ironed can obtained from the method in accordance with claim 11, wherein the can is manufactured from aluminum.

18. A body-necked, wall-ironed can obtained from the method in accordance with claim 1, wherein the can is manufactured from packaging steel.

19. The body-necked, wall-ironed can of claim 18, wherein the can is intended for being provided on one open side with an easily opening lid thereby to form a beverage can.

20. A body-necked, wall-ironed can obtained from the method in accordance with claim 1, wherein the can is manufactured from aluminum.

21. The body-necked, wall-ironed can of claim 20, wherein the can is intended for being provided on one open side with an easily opening lid thereby to form a beverage can.

22. The method in accordance with claim 1, wherein the can is intended for being provided on one open side with an easily opening lid thereby to form a beverage can.

23. The method in accordance with claim 1, wherein gas is injected into the can during said body-necking to place the can under an internal overpressure to support against axial overloading of the can during said body-necking.

24. The method in accordance with claim 23, wherein said body-necking occurs in the absence of an internal knock-out.

25. The method in accordance with claim 1, comprising forming a shoulder near a base of the can.

26. The method in accordance with claim 1, wherein the body necking is a continuous necking from the shoulder to said considerable distance along the can wall.

27. The method in accordance with claim 26, wherein the body necking is a continuous necking from the shoulder to a majority of the distance along the can wall.

28. The method of claim 1, further comprising, after said body necking, shaping said body necked considerable part of the height of the can by an expanding operation.

* * * * *